US005973451A

United States Patent [19]

Geis et al.

[11] Patent Number: 5,973,451

[45] Date of Patent: Oct. 26, 1999

[54] SURFACE-EMISSION CATHODES

[75] Inventors: Michael W. Geis, Acton; Nickolai N. Efremow, Melrose; Kevin E. Krohn, Chelmsford; Jonathan C. Twichell, Acton; Theodore M. Lyszczarz, Concord, all of Mass.

[73] Assignee: Massachusetts Institute of Technology, Cambridge, Mass.

[21] Appl. No.: 08/794,361

[22] Filed: Feb. 4, 1997

[51] Int. Cl.[6] ..... H01J 1/30

[52] U.S. Cl. ..... 313/495; 313/309; 313/311; 313/351

[58] Field of Search ..... 313/495, 512, 313/306, 308, 309, 311, 351, 310

[56] References Cited

U.S. PATENT DOCUMENTS

| | | | |
|---|---|---|---|
| 5,532,544 | 7/1996 | Yoshioka et al. | 313/351 X |
| 5,612,587 | 3/1997 | Itoh et al. | 313/351 X |
| 5,760,536 | 6/1998 | Susukida et al. | 313/495 X |

OTHER PUBLICATIONS

Umesh K. Mishra et al., "*Planar Cold Cathodes*", pp. 279–289, Dec. 1993.

J.L. Shaw et al., "*Graded Electron Affinity Electron Source*", pp. 2072–2079, Dec. 1996.

D.S. Herman et. al., Journal of Applied Physics, "Electrical Conduction Between Metallic Microparticles", vol. 37, No. 4, pp. 1594–1603.

Robert M. Hill, "*Electrical Conduction in Thin Aggregated Metal Films*", vol. 204, No. 4953, pp. 35–36, 1964.

R.M. Hill, "*Electrical Conduction in Aulta Thin Metal Films, I. Theoretical*", vol. 309, pp. 377–395, Dec. 1969.

T.S. Sundarshan et al., IEEE Trans. Electr., "Prebreakdown Processes Associated with Surface Flashover of Solid Insulators in Vacuum", vol. E1–12, No. 3, pp. 200–208, Dec. 1977.

Michael W. Geis et al., "*Fabrication and Theory of Diamond Emitters*", vol. 8, No. 2, pp. 161–172, Dec. 1995.

C.C. Grimes, "*electrons in Surface States on Liquid Helium*", pp. 379–395, Dec. 1978.

R.V. Latham, "*High Voltage Vacuum Insulation: The Physical Basis*", pp. 229–239, Dec. 1981.

*Primary Examiner*—Ashok Patel

*Attorney, Agent, or Firm*—Cesari and McKenna, LLP

[57] ABSTRACT

The surface-emission cathodes of the invention are constructed so that the cathode body has a free surface over which electrons are efficiently accelerated after injection from a conductive contact. The junction between the free surface and the contact has the property that the height of the barrier to tunneling from the contact to floating surface states associated with the free surface of the cathode body is lower than both the barrier to emission from the contact to vacuum and the barrier to injection from the contact into the conduction band of the cathode body material. Thus under an applied potential, electrons are injected from the contact into floating surface states associated with the free surface. After acceleration, electrons leave the free surface, either emitted to vacuum or injected into another medium.

45 Claims, 9 Drawing Sheets

SURFACE-EMISSION CATHODES

This invention was made with government support under ARPA contract no. F1962890C0002 awarded by the Department of Defense. The government has certain rights in this invention.

FIELD OF THE INVENTION

This invention relates to electron-emitting devices. More particularly, this invention relates to structures and compositions of surface-emission cathodes suitable for products such as flat-panel video displays and to fabrication techniques and methods therefor.

BACKGROUND OF THE INVENTION

The most commonly applied approach to field emission incorporates an atomically sharp tip that concentrates electric field lines of an applied potential, thus effecting local geometric field enhancement at the cathode-vacuum interface. The enhanced field facilitates electrons' tunneling into vacuum through the steep energetic barrier at the emission surface. Arrays of geometric field enhancement cathodes generally require an applied potential of 20 to 200 V to obtain practical working current densities, i.e. greater than 1 $mA/cm^2$.

Another approach employs as the cathode material an impurity-doped semiconductor having a surface with a negative electron affinity ("NEA"). The conduction band edge of such a material is higher than the vacuum energy level, so emission of conduction band electrons to vacuum from the bulk of the cathode body is energetically favored. However, in general there is a significant barrier to injection of electrons into the cathode material from a metal contact. If the semiconductor forms a Schottky diode on metals, then when an electric field is applied across the semiconductor, the dopant impurities become positively ionized and form a depletion region at the metal-semiconductor junction, giving rise to a local field enhancement. When nitrogen-doped diamond is used as this semiconductor, the electric field at this junction is often greater than $10^7$ V/cm, sufficient to cause tunneling of electrons from the metal into the semiconductor. Once the electrons are in the NEA semiconductor they can be emitted directly into vacuum. The dopant-induced field enhancement at the metal-semiconductor interface may be augmented by interface morphology, as described in U.S. Pat. No. 5,713,775 (FIELD EMITTERS OF WIDE BANDGAP MATERIALS AND METHODS FOR THEIR FABRICATION, filed May 2, 1995), hereby incorporated by reference. Cathode arrays using a dopant-induced electric field enhancement technique typically require 10 to 20 V to obtain practical working current densities.

Although excellent electron emission characteristics have been observed from known emitter structures, especially those incorporating cathode bodies of diamond and amorphous diamond-like materials, practical applications of these cathodes remains limited by a lack of performance reproducibility. Also, the electrons enter the vacuum from thermal equilibrium with the cathode body bulk, where they have been subject to many collisions; thus they have little kinetic energy and require an accelerating voltage in the region vacuum adjacent the emitting surface. Finally, field emitters operable using smaller working voltages would lower power requirements and make field emitters suitable for incorporation into a wider range of devices.

SUMMARY OF THE INVENTION

The surface-emission cathodes of the invention are constructed so that the cathode body has a free surface with first and second ends. A first conductive contact is in electrical communication with the first end. The junction between the free surface and the first conductive contact has the property that the height of the barrier to tunneling from the conductive contact to floating surface states associated with the free surface of the cathode body is lower than both the barrier to emission to vacuum from the contact and the barrier to injection from the contact into the conduction band of the cathode body material. Thus when the second end is at a positive potential with respect to the first conductive contact, electrons are injected from the first contact into floating surface sites associated with the free surface. The binding of the electrons to the floating surface states is sufficiently loose to allow acceleration of the electrons by the potential difference along the length over the free surface to the second end, at which they leave the free surface, either emitted to vacuum or injected into another medium. As used herein, the phrase "over the free surface" encompasses electron travel in states which are in or associated with the free surface but excludes free acceleration of electrons through vacuum in the region adjacent the free surface. Correspondingly, "leaving the free surface" denotes leaving such states.

In contrast with trapped states in the bulk and at the surfaces of many materials, the floating surface states associated with the free surface allow nearly ballistic travel of electrons along the free surface of emitters of the invention, with minimal interference due to collision, so that electrons are accelerated very efficiently. Electrons may travel in floating surface states over long distances, usually greater than 500 nm, even much greater than 1000 nm, up to several millimeters. Thus electrons leave the cathode body with kinetic energies equal to a significant fraction of the energy corresponding to completely loss-free acceleration of an electron through the imposed electric field, less the work function of the contact material, which for metals is on the order of 5 eV. This percentage may be as large as 20% or even greater. In a preferred embodiment, electrons leave the cathode body with kinetic energies corresponding to 50% of the imposed electric field, or even corresponding to greater than 80% or 90%. In the case of diamond, the figure may be higher as 98%. In some cases electrons leave the free surface with kinetic energies of greater than 50 eV, even greater than 500 eV or 1000 eV. Electrons are emitted from the free surface at imposed electric fields having average amplitudes along the length as low as $10^5$ V/m.

As used in this disclosure, the "free surface" of the cathode body is a surface along which the body does not abut another structure or device layer. Surfaces having negative electron affinity are particularly well suited to function as the free surface in emitters of the invention. Diamond, for example type Ib—which contains substitutional nitrogen, a deep donor, usually at a concentration in the range $10^{18}$ $cm^{-3}$ to $10^{22}$ $cm^{-3}$—or CVD diamond, forms particularly efficient emitters. The emitters work best when the preparation of the free surface includes cleaning the surface well, for example by cleaving the cathode body to expose a fresh surface or by exposing the cathode body to a molten salt, especially sodium nitrate.

In a preferred embodiment, the free surface has been treated with atoms of an alkali or alkali earth metal, especially cesium or barium, to enhance its electron-emissive properties, by any one of the processes known to those skilled in the art. (See, e.g., U.S. Pat. No. 5,463,271, herein incorporated by reference.) As used in this disclosure, the term "cesiation" refers to the treatment of a surface with cesium to form a cesium-containing coating that lowers the electron affinity of the surface. Although it contains metal atoms, the surface resulting from such a treatment is to be distinguished from a truly metallic surface, which is understood to be a continuous aggregate of metallically bonded material, for example a metallization layer serving as an electrical contact.

In a preferred embodiment, the cathode body contains dopants which ionize in the vicinity of the junction, thereby locally enhancing the biasing electric field, so that injection into floating surface states over the free surface can occur at lower overall applied voltages. Nitrogen, especially substitutionally placed nitrogen, effectively plays this role in diamond cathode bodies. Such local electric field enhancement by ionized dopants may be effected in conjunction with morphology that sharpens the profile of the energy barrier to injection from the at the junction.

The cathode body may be of a wide-bandgap semiconductor such as silicon carbide or one of the group III nitrides. For the purposes of this disclosure, a wide-bandgap semiconductor is defined to be a semiconductor material having a bandgap of at least 2.0 eV. Quartz doped with alkali earth ions, for example a borosilicate glass, is also a cathode body material candidate. In a preferred embodiment, the cathode body is of diamond, oriented so that the free surface is an NEA diamond surface. The first conductive contact is preferably a metal, most preferably one of iron, nickel, cobalt, titanium, and the lanthanides.

In one of its aspects, the invention provides a novel construction of the junction between the free surface and the first contact to enhance the energetics of electron transfer from the first contact to the floating surface states over the free surface. According to this aspect, the free surface has a convoluted section near which it joins the first contact. The convoluted section includes noncoplanar portions of the free surface that interact to form composite floating surface states having lower energy than the floating surface states of a single planar free surface, thereby facilitating electron injection to states over the free surface. As used herein, the phrase "convoluted section" denotes a continuous surface with a sufficiently high radius of curvature to enable the creation of the composite floating states; and the term "floating surface state" may denote a floating state associated with a single free surface or a composite floating state generated by the interaction of portions of a convoluted section. In one approach, the convoluted section of the cathode body comprises the interior surfaces of a plurality of narrow of cylindrical tunnels through the cathode body to an underlying conductive substrate that serves as the conductive contact. In an alternate approach, the convoluted section is microscopically corrugated, although part of a macroscopically flat surface.

In one embodiment, the emitter of the invention includes a second conductive contact, in electrical communication with the second end of the cathode body, at which a power supply is connected for applying a voltage across the length of the free surface. In an alternate embodiment, the emitter is operated by applying a voltage between the first contact and an anode separated from the cathode body by an expanse of vacuum. A remote anode may also serve to provide further acceleration to electrons emitted from the free surface.

In one or more of its aspects, the invention provides emitters that perform predictably and reproducibly, even in atmospheres containing nitrogen or oxygen. Cathodes of the invention incorporating a diamond cathode body typically exhibit a turn-on voltage of only a few volts and require only 6 to 10 volts to achieve a surface-emitted current of about $10^{-5}$ A/cm. For a 100-$\mu$m-diameter cathode with an emitting perimeter, this value is equivalent to a current density greater than 1 mA/cm$^2$.

The energetic-electron emitters of the invention are, for example, appropriate for cold cathodes in flat-panel displays. The invention furthermore provides light-emitting devices in which energetic electrons leaving the cathode material pass directly into a phosphor material and excite luminescence. The high electron energies available allow the electrons to surmount the energetic barrier between the cathode and phosphor materials and eliminate the need for intermediate acceleration.

BRIEF DESCRIPTION OF THE DRAWINGS

The invention description below refers to the accompanying drawings, of which:

FIGS. 4A–4C illustrate the structure of an emitter of the invention, particularly as described in Example 1, of which FIGS. 4A and 4B are elevations and FIG. 4C is a section taken along line C—C';

FIGS. 5A and 5B illustrate the structure of an emitter of the invention, particularly as described in Example 2, of which FIG. 5A is an elevation and FIG. 5B graphically depicts the I–V characteristic of the emitter;

FIGS. 6A and 6B illustrate the structure of an emitter of the invention, particularly as described in Example 3, in which FIG. 6A is a cross-section and FIG. 6B graphically depicts the I–V characteristic of the emitter;

Figure 1:
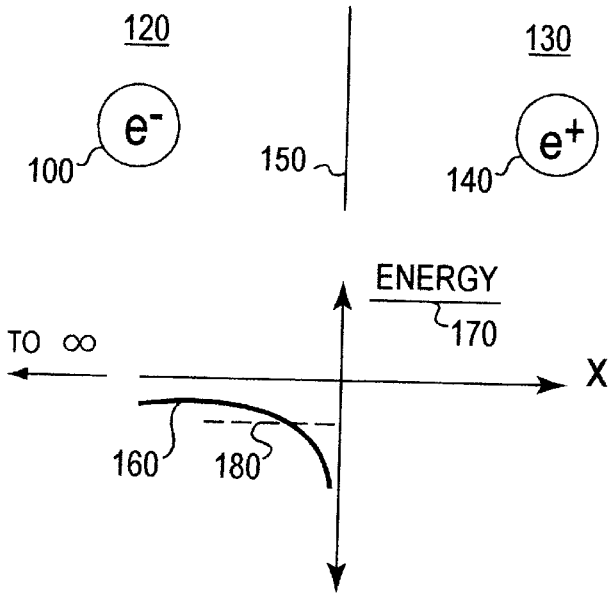
FIG. 1 schematically depicts the interaction of an electron with a NEA surface.

Features in the drawings are not, in general, drawn to scale.

DETAILED DESCRIPTION OF THE INVENTION

The role played by floating surface states in the function of emitters of the invention can be understood with reference to the special case of an electron in vacuum near a flat surface having a negative electron affinity. With reference to FIG. 1, an electron 100 in vacuum 120 is attracted to an electrically neutral material 130 by its image charge 140 in the material 130. The potential energy of the electron 100 falls from its value at infinity as it approaches the surface 150 of the material 130, varying as the reciprocal of its distance from the surface 150, as shown by curve 160. Since the surface 150 has a negative electron affinity, the conduction band edge 170 of the material 130 near the surface 150 is, by definition, at a higher energy than the vacuum level; an energetic barrier prevents the electron's entering the bulk of the material 130.

However, no barrier guards the electron from entering floating surface states over the surface 150. Such floating surface states have been observed over some vacuum-metal and vacuum-NEA interfaces. The electron wave functions of these states approach zero at the surface 150. The average displacement D of the electron from the interface in the lowest of the floating surface states is $D=2\alpha_0$, $$D = 2a_0\frac{(\varepsilon+1)}{(\varepsilon-1)},$$

in which $\alpha_0$ is the Bohr radius, and $\epsilon$ is the dielectric constant of the material 130. In the case of diamond, which has a dielectric constant of about 5.7, an electron in a free surface state resides about 0.3 nm above the surface 150. The magnitude of the corresponding one-dimensional hydrogenic quantum binding energy E is approximated by, $$e = \frac{(R(\varepsilon-1))^2}{16(\varepsilon+1)^2},$$

in which R is the Rydberg constant. In the case of diamond, this energy is 0.42 electron volts, indicated by dashed line 180. Thus the injection of an elcctron from a metal contact to a floating surface state is more favorable than its emission to vacuum by about half an electron volt.

Figure 2:
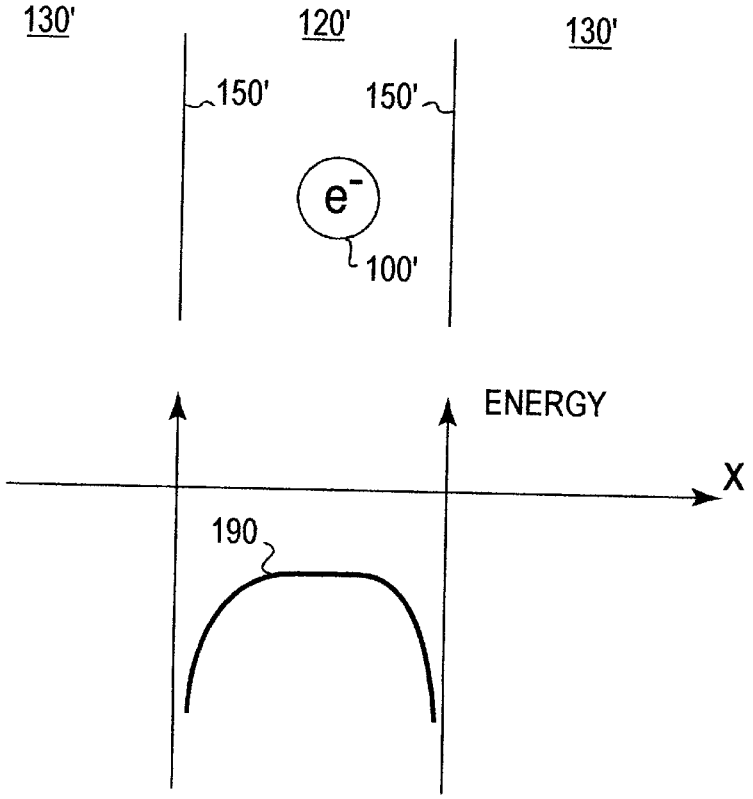
FIG. 2 schematically depicts the interaction of two NEA surfaces to give rise to a composite floating surface state.

The enhancement of device operation due to convolution of the interface between the contact and the free surface can be understood with reference to FIG. 2. The respective floating surface states of two flat, parallel NEA surfaces 150', separated by a sufficiently small distance d, interact to gives rise to composite floating surface states. The interaction of the respective states effectively reduces the vacuum level at "infinity" between the surfaces 150', which tends to reduce the magnitude of the composite-state energy compared to the Rydberg term calculated above for a floating state associated with a single surface. However, a particle-in-a-box term due to the confinement between the surfaces 150' of an electron 100' in such a composite state increases the energy level of the state. The $E_{min}$ of the lowest energy composite state, represented by the curve 190, is then approximated by $$E_{\min} = \frac{(R(\varepsilon-1))^2}{16(\varepsilon+1)^2} + \frac{(\varepsilon-1)}{8\pi d(\varepsilon+1)} - \frac{\hbar^2}{2md^2}$$

in which e is the electronic charge, $\epsilon_0$ is the permittivity of vacuum, and m is the mass of the electron.

Figure 3:
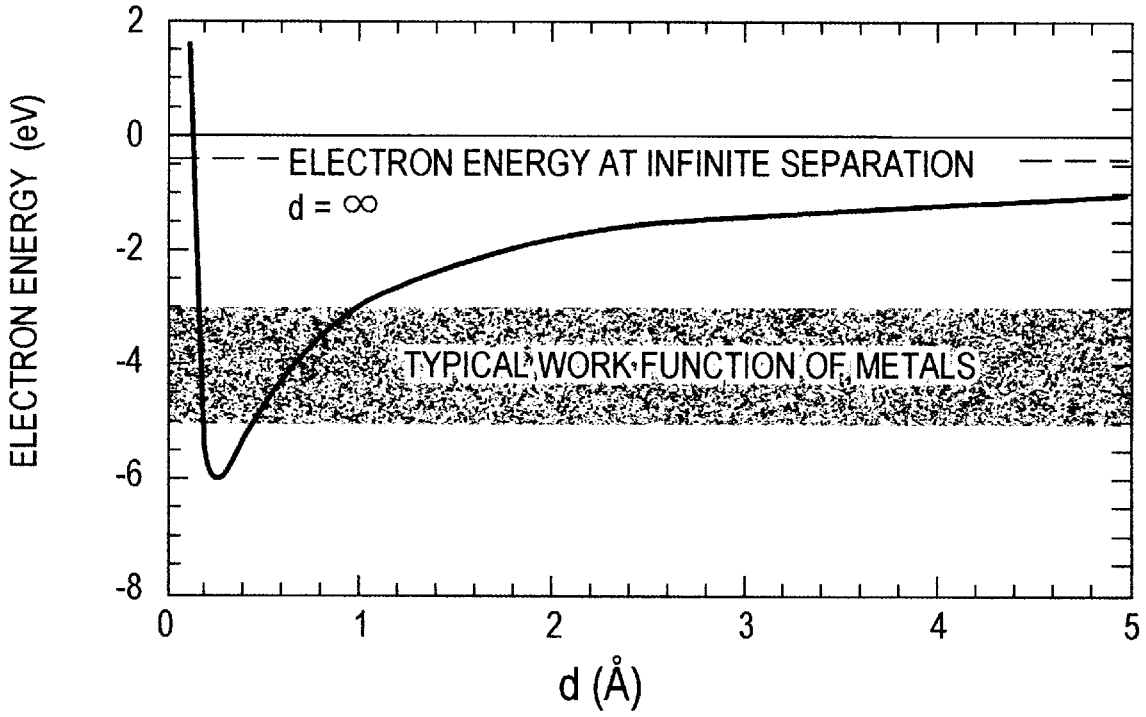
FIG. 3 graphically depicts the energy profile of an electron between two interacting NEA surfaces.

The energy profile of the electron 100' in a composite floating surface state, plotted in FIG. 3, shows that the electron energy is lower than the work function, i.e., the energy increment separating a metal fermi level from the vacuum level at infinity, in the case of many metals. Even for separations up to 10 Å, the energy of the composite surface state is significantly lower than the level of a floating single-surface state, signified by $d=\infty$. (According to the model, the composite state energy increases for very small values, around 0.2 nm, of the wall separation d. Since this value is smaller than the crystallographic unit cell of most materials—for example, the diamond unit cell is 0.36 nm on a side—the model is probably overly simplistic in this regime.) Thus, the interaction of the two surfaces 150' in the vicinity of the junction of a metallic contact significantly improves the energetics of electron injection from a metallic contact into floating states over a free surface without altering the work function of the metallic contact material. The increased energy gap between the floating surface states and the vacuum level at infinity that must be traversed in order to enable emission to vacuum is easily overcome by the high kinetic energies that the electrons attain during acceleration over the free surface.

The interacting surfaces 150' need not belong to distinct bodies in order to produce the energetic benefit. For example, they may be noncoplaniar portions of a single surface that has a sufficiently small radius of curvature to allow the portions to interact. entire free surface of the invention may have a convoluted profile, for example may be circular- or rectangular-cylindrical; or the free surface may include a convoluted section comprising locally curved portions of a macroscopically flat region.

The operation and fabrication of surface-emission cathodes of the invention are demonstrated by the following examples.

EXAMPLE 1

Figure 4A:
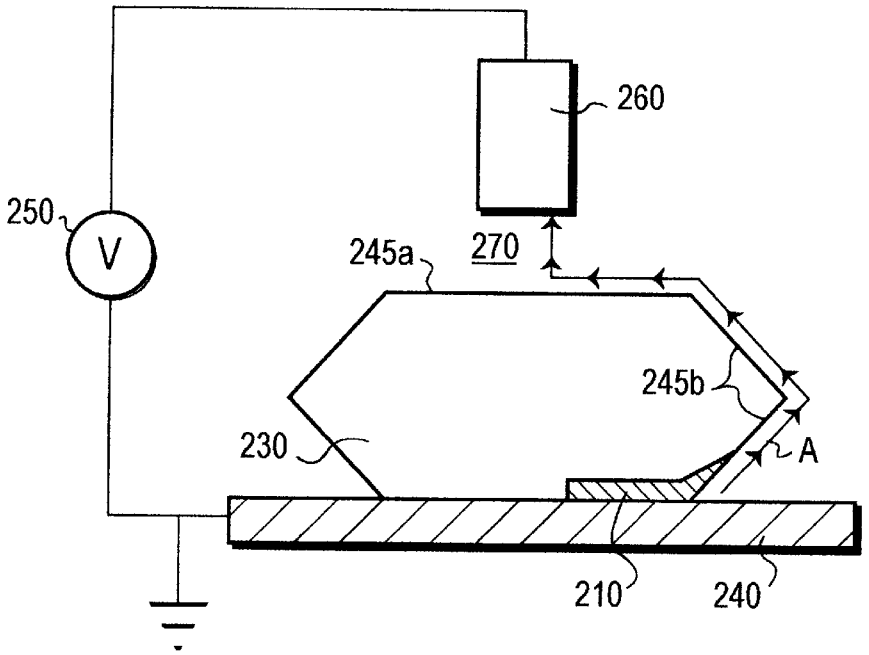

With reference to FIG. 4A, a region 210 of a type-Ib diamond 230, about 3 mm on a side, was ion-implanted with carbon cations to serve as a first conductive contact to the diamond 230. The implanted region 210 was joined to a metal support 240. The diamond was exposed to an oxygen discharge, treated with cesium, and the reexposed to oxygen in order to enhance the NEA of the surfaces 245*a* and 245*b* of the diamond 230. A voltage source 250 imposed a potential between the metal support 240 and an anode 260, biased to a dc potential of 0 to 10 kV and separated from the diamond 230 by an expanse 270 of vacuum of 0 to 0.8 mm. Electrons left the top surface 245*a* and traveled to the anode 260, apparently following the path from the implanted region 210 indicated by the arrow A, along which the surfaces 245*a* and 245*b* of the diamond 230 glowed green yellow.

Figure 4B:
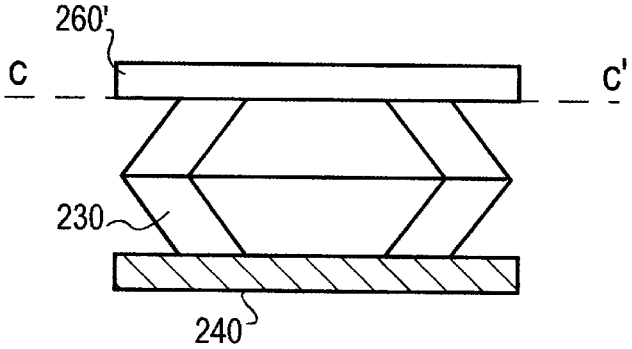
Figure 4C:
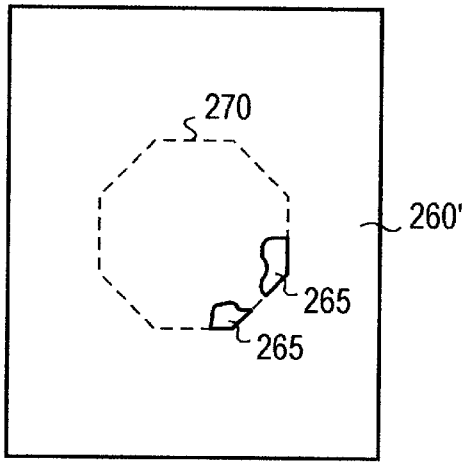

Then a phosphorescent screen 260' having a 1-keV-luminescence threshold was used as the anode, placed directly on the top surface 245*a* of the diamond 230, as indicated in FIG. 4B. When 1 to 7 kilovolts was applied between the metal support 240 and the screen 260', the screen fluoresced in regions 265 near its intersection with the perimeter 270 of the diamond 230, as shown in FIG. 4C. The electrons evidently leave the surface 245*a* or 245*b* with kinetic energies equal to or greater than 1 keV.

EXAMPLE 2

Figure 5A:
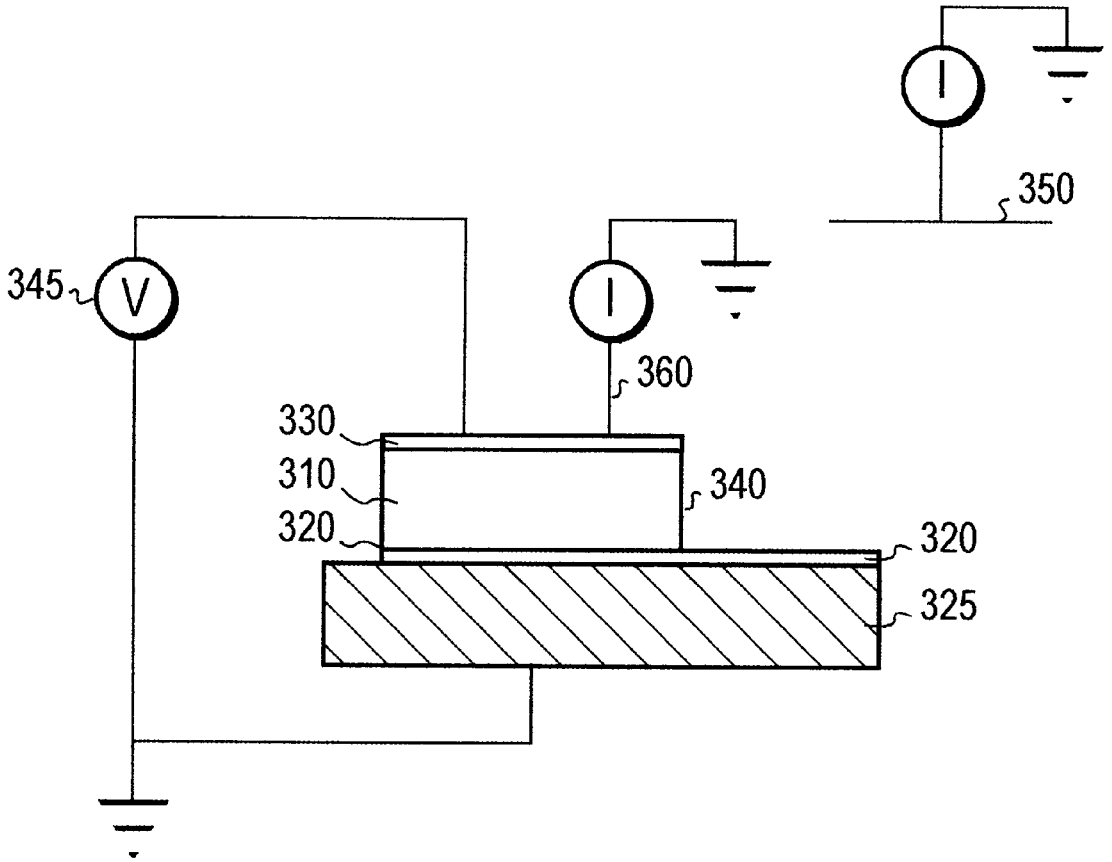
Figure 5B:
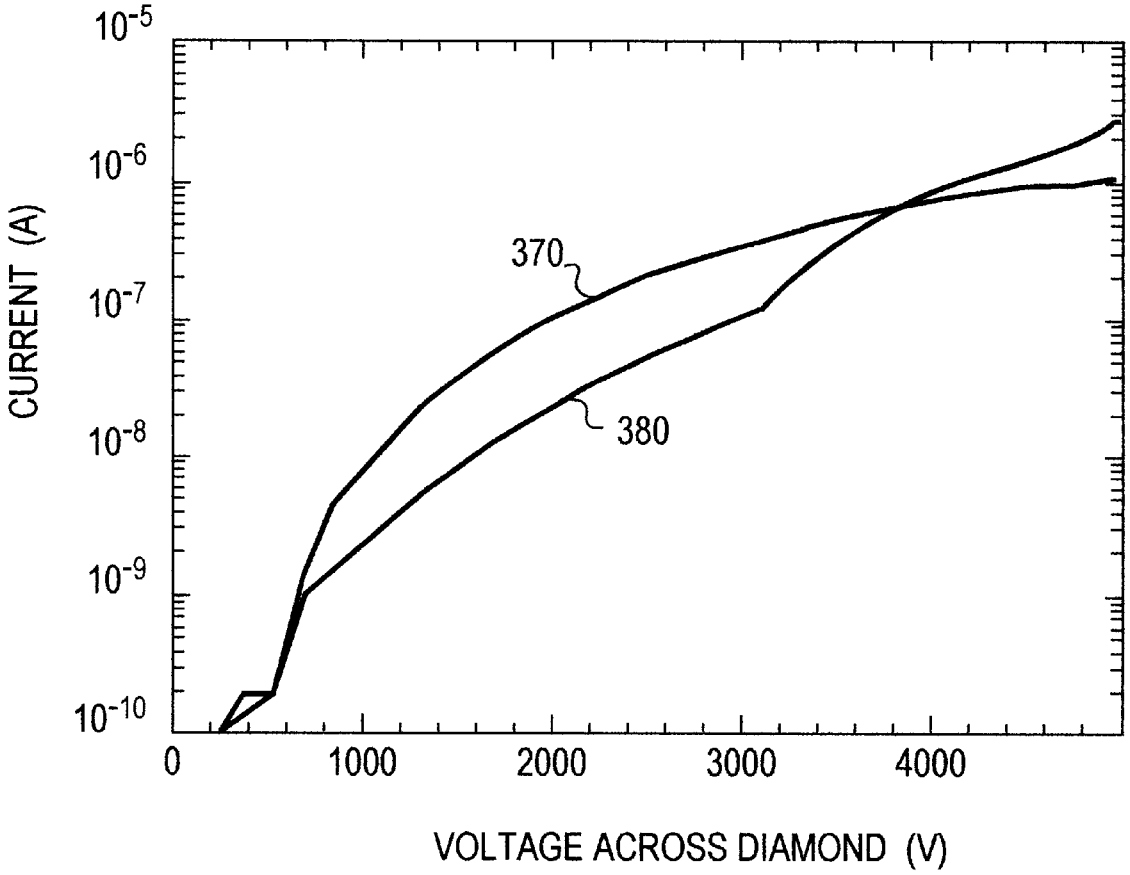

With reference to FIG. 5A, a 100-$\mu$m-thick diamond plate 310 was coated on one side with a nickel layer 320, which was joined to a metallic substrate 325. The opposite side of the diamond plate 310 was graphitizcd to form a conductive layer 330. The diamond was then cleaved and a portion removed to expose a clean, undamaged surface 340. When a voltage source 345 applied a few kilovolts between the nickel layer 320 and the graphitized layer 330, electrons were emitted into vacuum and collected by a collector 350; some current to the top electrode 330 was also detected through circuit 360. In FIG. 5B, curves 370 and 380 respectively show the I–V characteristics of the emitted current and of the electrode current. By using a movable phosphor screen (not shown), it was determined that these electrons originated from the cleaved free surface 340 and that they were nearly monoenergetic, with kinetic energies nearly equivalent to the applied potential, sometimes within 50 eV of the applied potential.

EXAMPLE 3

Figure 6A:
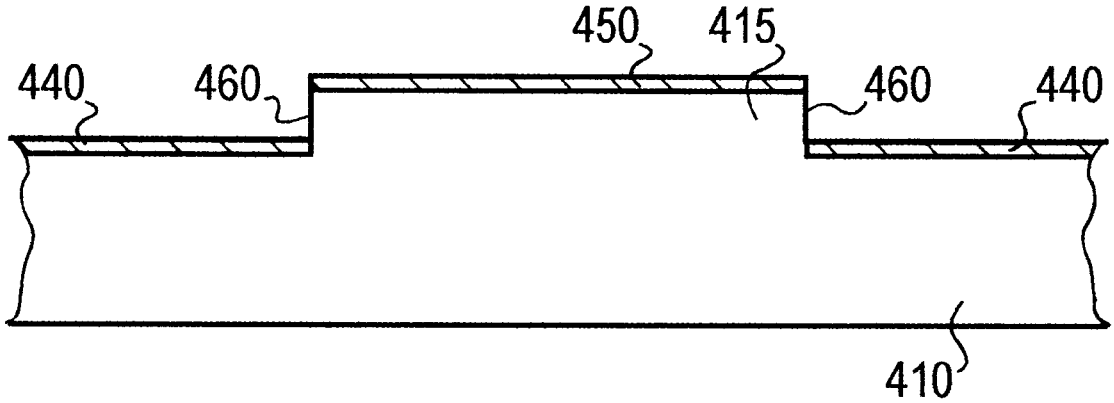

With reference to FIG. 6A, an emitter was formed in a slab 410 of type-Ib diamond. The emitter features a raised portion 415 in the slab 410. The top surface of the raised portion and the lower surfaces of the slab 410 are covered by a 50-nm film of nickel metal. The lower nickel film 440 serves as the first conductive contact; the upper nickel film 450 serves as the second conductive contact. The uncoated free surfaces 460 are about 1.5 $\mu$m long.

This device was fabricated by forming array of raised squares in a flat slab by depositing an aluminum layer, patterning the aluminum layer, and etching away diamond around the patterned squares by etching in a flux of $NO_2$ while impinging the surface with 1200-eV xenon cations. After removal of the aluminum mask, the structure was cleaned in molten sodium nitrate at about 400° C. to remove insoluble nondiamond carbon compounds from the diamond surfaces. Then the nickel films 440 and 450 were deposited by electron-beam evaporation. It was found that 5-to-50-nm-thick nickel layers formed good contacts. Depositing thicker films usually caused some undesired deposition on the cleaned free surfaces 460. A slab of CVD diamond suitable for making this structure could be made by growing CVD diamond on a sacrificial substrate and then removing the substrate to expose the smooth CVD surface.

Figure 6B:
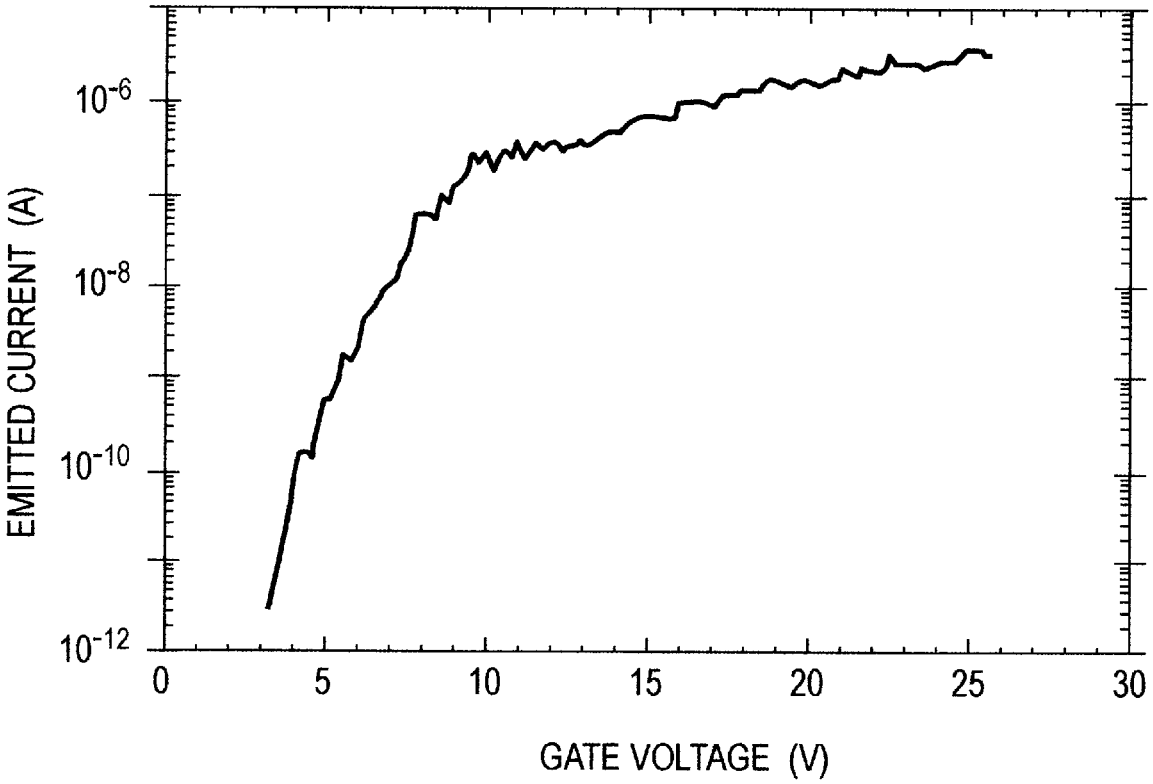

FIG. 6B shows the emission current from the free surfaces 460 of this device as a function of the gate voltage applied across the first and second conductive contacts. The current to the film 450 was on the order of $10^2$ to $10^4$ times the emitted current. Measurable emission occurs at applied potentials substantially less than 4 V. Adequate currents for use in flat-panel displays are obtained at voltages less than 10 V.

EXAMPLE 4

Figure 7A:
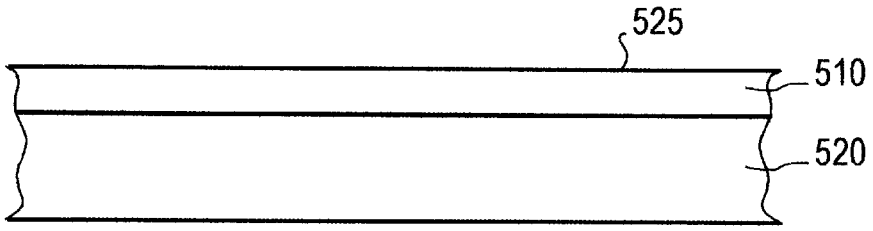
FIG. 7 illustrates an emitter structure of the invention comprising an array of tunnels through a diamond layer, particularly as described in Example 4.
Figure 7B:
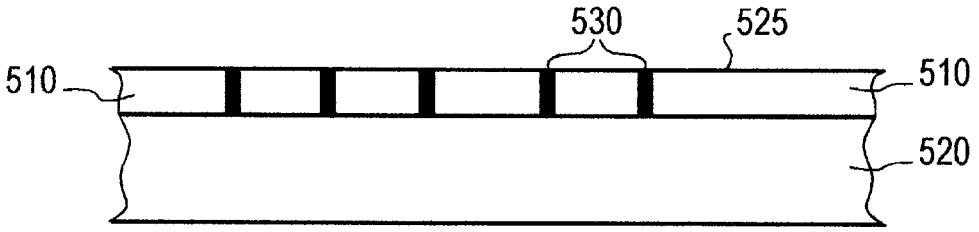
Figure 7C:
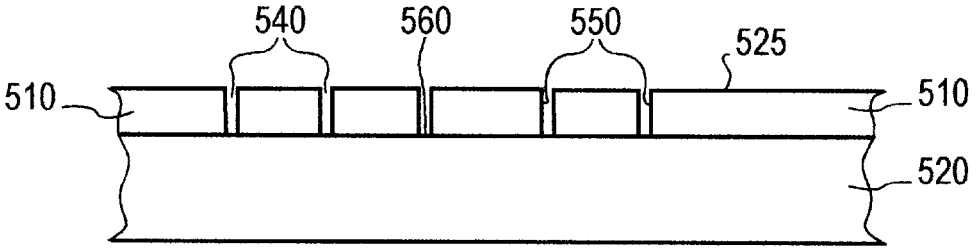
Figure 7D:
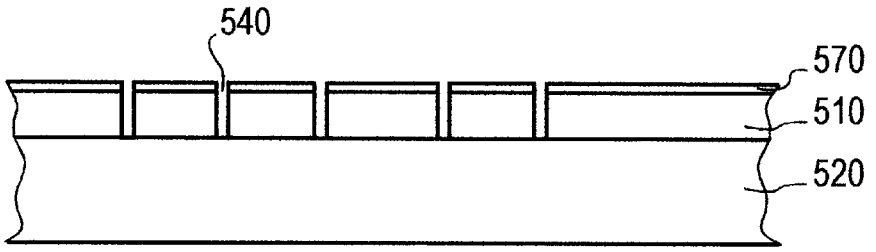

A 1-$\mu$m layer 510 of nitrogen-doped diamond is deposited by chemical vapor deposition over a conductive substrate 520 of metal or heavily doped silicon to form the structure shown in FIG. 7A. The top diamond surface 525 is then subjected to a current of uranium ions having ion energies greater than $10^7$ eV, sufficient to damage the diamond layer 510. The resulting graphite traces 530, shown in FIG. 7B, each correspond to the pathway of a heavy ion through the thickness of the layer 510. The traces 530 are removed using an oxygen plasma, thereby forming an array of tunnels 540. With reference to FIG. 7C, the interior surfaces 550 of the array of tunnels 540, each having diameter from 0.5 to 10 nm, provide a convoluted free surface joined at the bottom 560 of each tunnel 540 to the conductive substrate 520. Treating the diamond surface 525 with a higher flux of argon ions having energies from $10^3$ to $10^5$ eV provides a damaged layer 570 serving as the second conductive contact, as shown in FIG. 7D.

EXAMPLE 5

Figure 8:
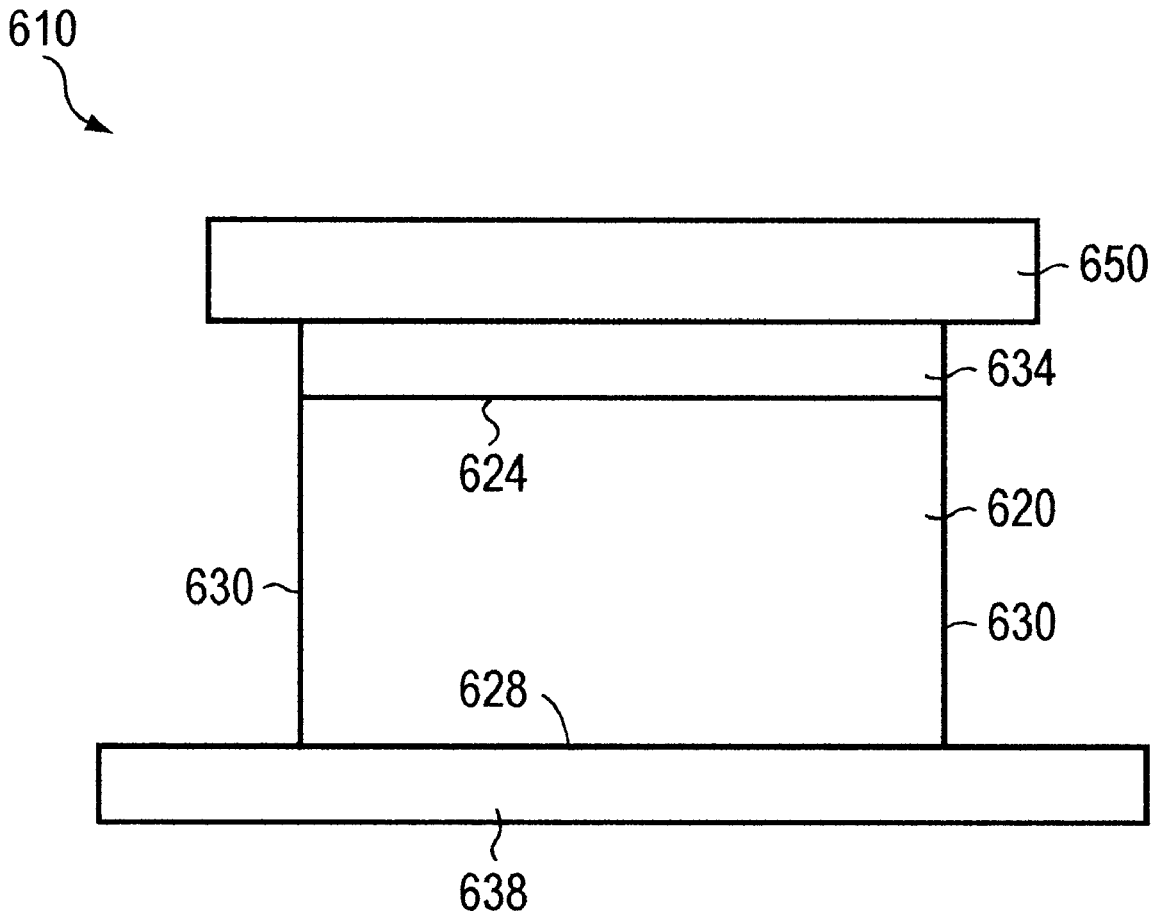
FIG. 8 is an elevation illustrating the emitter structure of the invention including a luminescent layer, particularly as described in Example 5.

With reference to FIG. 8, a flat-panel light-emitting device of the invention, generally designated at 610, includes a cathode body 620 of cesiated diamond having a front surface 624 and a back surface 628. The free surface 630 of the body 620 is in contact with a first conductive contact 638 at the back surface 628 and with a second conductive contact 634 at the front surface 624. The second contact 634 is a thin conductive layer, no thicker than several nanometers, preferably of metal or graphite. The device 610 is optionally housed in an evacuated chamber. A voltage source imposes a potential difference between the first and second conductive contacts 638 and 634. A layer 650 of phosphor material, such as, for example, zinc oxide, is disposed over the second contact 634. In operation, electrons are injected from the first contact 638 onto the free surface 630, are accelerated over the free surface 630 toward the second contact 634, and leave the free surface 630 and enter the layer 650, without emission to vacuum, thereby exciting the phosphor material to luminescence.

It will therefore be seen that the foregoing represents a highly advantageous approach to the construction of field-emission devices, especially those incorporating diamond and other wide-bandgap materials. The terms and expressions employed herein are used as terms of description and not of limitation and there is no intention, in the use of such terms and expressions, of excluding any equivalents of the features shown and described or portions thereof, but it is recognized that various modifications are possible within the scope of the invention claimed. For example, the free surface of the emitter may be coplanar with one or both of the conductive contacts, the extent of each of the features being lithographically defined.

What is claimed is:

1. An electron-emissive device comprising:

a. a first contact of a first conductive material;

b. a cathode body having a free nonmetallic surface with a first end and a second end separated by a length, the first end being electrically coupled to the contact, the surface facilitating electron transport thereover so that upon imposition of an electric field across the length, electrons leave the contact and travel over the surface from the first end along the length and leave the free surface with kinetic energies equal to at least 50% of the energy corresponding to completely loss-free acceleration of an electron through the imposed electric field, less the work function of the first conductive material; and c. an electrode of a second conductive material, situated to receive electrons after they leave the free surface.

2. The device of claim 1 wherein the length is greater than 100 nanometers.

3. The device of claim 1 wherein the free nonmetallic surface has a negative electron affinity.

4. Fhe device of claim 1 wherein the electrons travel over the surface in floating surface states.

5. The device of claim 1 wherein the electrons leave the free surface upon imposition of an electric field having an average amplitude of at least $10^5$ V/m along the length.

6. The device of claim 1 wherein electrons leaving the cathode body have energies of at least 50 eV.

7. The device of claim 1 wherein electrons leaving the cathode body have energies of at least 500 eV.

8. The device of claim 1 further comprising phosphor material arranged to receive electrons leaving the cathode body, the phosphor material thereby being excited to emit light.

9. The device of claim 1 wherein the electrode is a second contact of a second conductive material, electrically coupled to the second end.

10. The device of claim 1 further comprising an anode opposing the cathode body across an expanse of vacuum.

11. The device of claim 10 further comprising a first voltage source coupled to the anode and configured to apply a voltage that accelerates electrons leaving the cathode body toward the anode.

12. The device of claim 11 further comprising a second voltage source configured to impose the electric field across the length.

13. The device of claim 1 further comprising a voltage source configured to impose an accelerating electric field on the electrons upon their leaving the cathode.

14. The device of claim 9 further comprising a voltage source electrically coupled to the first and second contacts.

15. The device of claim 10 further comprising a voltage source electrically coupled to the first contact and the anode.

16. The device of claim 1 wherein the first conductive material comprises nickel.

17. The device of claim 1 wherein the first conductive material comprises one of iron, nickel, cobalt, titanium, and a lanthanide.

18. The device of claim 1 wherein the cathode body is of a cathode body material, the first conductive material comprising cathode body material damaged by ion implantation.

19. The device of claim 18 wherein the cathode body is diamond and the ions are carbon or lithium.

20. The device of claim 1 wherein the free surface has been treated with a molten salt.

21. The device of claim 1 wherein the free surface has been formed by cleavage of the cathode body.

22. The device of claim 1 wherein the free nonmetallic surface comprises barium atoms.

23. The device of claim 22 wherein the free nonmetallic surface comprises oxygen atoms.

24. The device of claim 1 wherein the free nonmetallic surface comprises cesium atoms.

25. The device of claim 24 wherein the free nonmetallic surface comprises oxygen atoms.

26. The device of claim 1 wherein the cathode body comprises a wide-bandgap semiconductor.

27. The device of claim 1 wherein the cathode body comprises a group III nitride.

28. The device of claim 1 wherein the cathode body comprises silicon carbide.

29. The device of claim 1 wherein the cathode body comprises diamond.

30. The device of claim 29 wherein the diamond contains nitrogen.

31. The device of claim 29 wherein the nitrogen is present at a concentration in the range $10^{18}$ $cm^{-3}$ to $10^{22}$ $cm^{-3}$.

32. The device of claim 29 wherein the diamond is type Ib diamond.

33. The device of claim 29 wherein the diamond is CVD diamond.

34. The device of claim 1 wherein the imposed electric field is a DC field.

35. The device of claim 1 wherein the free surface has been treated with an emission-enhancing material.

36. The device of claim 1 wherein the free surface has a convoluted section, the first contact meeting the free surface at the convoluted section.

37. The device of claim 36 wherein the convoluted section has features characterized by radius of curvature less than 10 nm.

38. The device of claim 37 wherein the convoluted section is cylindrical.

39. The device of claim 37 wherein the convoluted section is macroscopically planar.

40. The device of claim 36 wherein convolution gives rise to composite floating surface states which promote injection of electrons onto the free surface from the contact.

41. An electron-emissive device comprising:

a. a contact of a first conductive material;

b. a cathode body having a free, negative-electron-affinity surface with a first end and a second end separated by a length, the first end being electrically coupled to the contact, the surface facilitating electron transport thereover so that upon imposition of an electric field across the length, electrons leave the contact and travel over the surface from the first end along the length and leave the free surface with kinetic energies equal to at least 50% of the energy corresponding to completely loss-free acceleration of an electron through the imposed electric field, less the work function of the first conductive material;

c. an electrode of a second conductive material, situated to receive electrons after they leave the free surface.

42. An electron-emissive device comprising:

a. a contact of a first conductive material;

b. a cathode body having a free surface with a first end and a second end separated by a length, the free surface having a convoluted section, the contact being electrically coupled to the free surface at the convoluted section, the coupling at the convoluted surface enhancing injection of electrons over the surface, the surface facilitating electron transport thereover so that upon imposition of an electric field across the length, electrons leave the contact and travel in the surface from the first end along the length and leave the free surface with kinetic energies equal to at least 50% of the energy corresponding to completely loss-free acceleration of an electron through the imposed electric field less the work function of the conductive material;

c. an electrode of a second conductive material, situated to receive electrons after they leave the free surface.

43. An electron-emissive device comprising:

a. a contact of a first conductive material;

b. a diamond cathode body having a free surface with a first end and a second end separated by a length, the first end being electrically coupled to the contact, the surface facilitating electron transport thereover so that upon imposition of an electric field across the length, electrons leave the contact and travel over the free surface from the first end along the length and leave the free surface with kinetic energies equal to at least 80% of the energy corresponding to completely loss-free acceleration of an electron through the imposed electric field less the work function of the conductive material; and c. an electrode of a second conductive material situated to receive electrons after they leave the free surface.

44. An electron-emissive device comprising:

a. a contact of metal comprising nickel;

b. a cathode body of nitrogen-containing diamond, the body having a free surface with a first end and a second end separated by a length, the surface being cesiated, the first end being electrically coupled to the contact, the surface facilitating electron transport thereover so that upon imposition of an electric field across the length, electrons leave the contact and travel over the free surface from the first end along the length and leave the free surface with kinetic energies equal to at least 80% of the energy corresponding to completely loss-free acceleration of an electron through the imposed electric field less the work function of the metal;

c. an electrode of a conductive material, situated to receive electrons after they leave the free surface.

45. An electron-emissive device comprising:

a. a contact of a first conductive material;

b. a cathode body having a free surface with a first end and a second end separated by a length, the first end being electrically coupled to the contact, the free surface having floating surface states associated therewith, the floating surface states facilitating electron transport over the free surface so that upon imposition of an electric field across the length, electrons leave the contact and travel from the first end along the length in the floating surface states and leave the free surface with kinetic energies equal to at least 50% of the energy corresponding to completely loss-free acceleration of an electron through the imposed electric field;

c. an electrode of a second conductive material, situated to receive electrons after they leave the free surface.

* * * * *